US006043419A

United States Patent [19]

Arbiter

[11] Patent Number: 6,043,419

[45] Date of Patent: Mar. 28, 2000

[54] HOOP AND COUNTER-HOOP TUNING DEVICE FOR A DRUM

[76] Inventor: Ivor David Arbiter, Melody Lodge, Tenterden Gardens, London NW4 1TG, United Kingdom

[21] Appl. No.: 09/117,960

[22] PCT Filed: Feb. 6, 1997

[86] PCT No.: PCT/GB97/00355

§ 371 Date: Mar. 2, 1999

§ 102(e) Date: Mar. 2, 1999

[87] PCT Pub. No.: WO97/29479

PCT Pub. Date: Aug. 14, 1997

[30] Foreign Application Priority Data

| | | | |
|---|---|---|---|
| Feb. 7, 1996 | [GB] | United Kingdom | 9602433 |
| May 22, 1996 | [GB] | United Kingdom | 9610795 |
| Aug. 28, 1996 | [GB] | United Kingdom | 9617963 |

[51] Int. Cl.[7] ..... G10D 13/02

[52] U.S. Cl. ..... 84/411 R; 84/411 A; 84/413

[58] Field of Search ..... 84/411 A, 411 R, 84/413, 418, 419, 421, 269, 272

[56] References Cited

U.S. PATENT DOCUMENTS

| | | | |
|---|---|---|---|
| 2,485,985 | 10/1949 | Perry | 84/411 R |
| 4,079,657 | 3/1978 | Sobreira | 84/411 R |
| 4,483,234 | 11/1984 | Snavely | 84/269 |
| 4,619,179 | 10/1986 | Wright | 84/413 |
| 4,754,683 | 7/1988 | Townsend et al. | 84/413 |
| 5,157,212 | 10/1992 | Fleming | 84/413 |
| 5,309,810 | 5/1994 | May | 84/413 |
| 5,587,544 | 12/1996 | Fujii et al. | 84/411 R |

FOREIGN PATENT DOCUMENTS

| | | |
|---|---|---|
| 95 131 | 1/1897 | Germany . |
| 566816 | 3/1932 | Germany . |
| 629 075 | 4/1936 | Germany . |
| 919082 | 10/1954 | Germany . |
| 1073282 | 1/1960 | Germany . |
| 1120851 | 12/1961 | Germany . |
| 613316 | 6/1946 | United Kingdom . |
| 1 488 167 | 10/1977 | United Kingdom . |
| 1 558 045 | 12/1979 | United Kingdom . |
| 2 302 200 | 1/1997 | United Kingdom . |

*Primary Examiner*—Brian Sircus
*Assistant Examiner*—Kim Lockett
*Attorney, Agent, or Firm*—Patterson & Keough, P.A.

[57] ABSTRACT

A drum includes a drum shell, a drum head, a counter-hoop and a shell hoop. A drum skin extends over the open end of the drum shell and has a circumferential bead. The counter-hoop has a downwardly and outwardly extending flange which bears on the bead. The shell hoop has a rim which extends upwardly and outwardly. An adjustable clamp ring engages the flange of the counter-hoop and the rim of the shell hoop through correspondingly inclined portions. The clamp ring has a breach and a tightening mechanism so that when the clamp ring is tightened, the counter-hoop is forced downwards, thereby tightening the skin.

27 Claims, 5 Drawing Sheets

FIG. 3
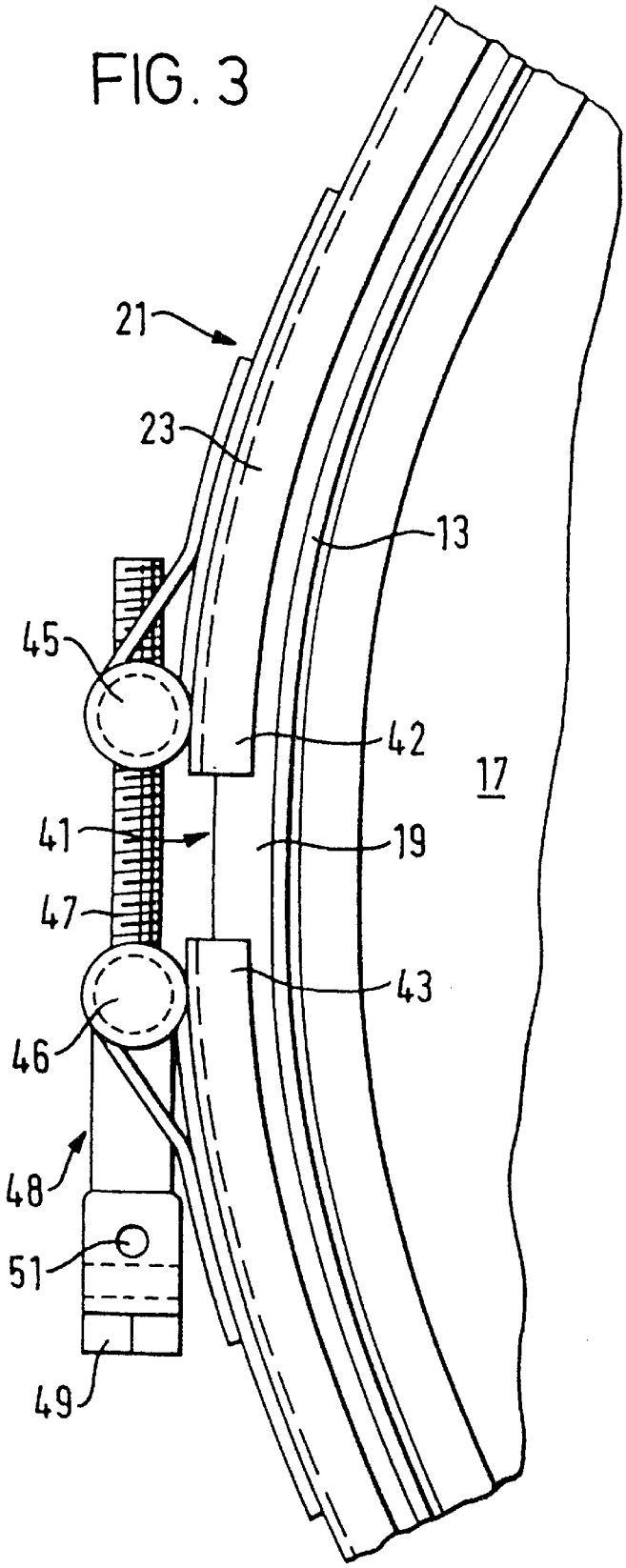
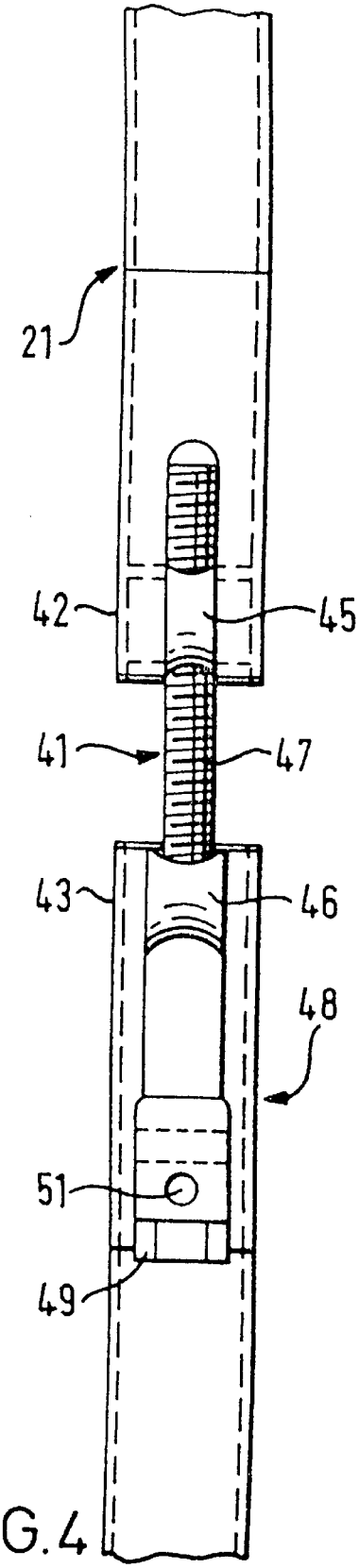
FIG. 4

HOOP AND COUNTER-HOOP TUNING DEVICE FOR A DRUM

BACKGROUND OF THE INVENTION

1. Field of the Invention

The present invention relates to drums, that is to say percussion instruments, such as snare drums, tom-toms, bass drums, tympanis, and the like. The invention is particularly concerned with the tuning of drum heads.

2. Description of Related Art

In conventional drums, the skin of the drum head is stretched over the open end of a cylindrical drum shell and is held in position by means of a counter-hoop which bears on the rim of the head. The skin is tensioned by means of tensioning bolts which act on the counter-hoop and engage tapped fittings fixed to the drum shell. When these bolts are tightened, the counter-hoop is urged against the rim, thus tensioning the skin.

In order to ensure that the skin is evenly tensioned and is therefore "tuned", it is necessary to adjust minutely each of the bolts, which are usually at least six or eight in number. This procedure is complicated by the fact that when one bolt is adjusted it has differing effects on the tension in the skin produced by the other bolts, making tuning a very time consuming and skilled operation.

Two related proposals which seek to address this disadvantage are described in British Patent Nos. 1488167 and 1558045. In the first of these references, the counter-hoop has a series of circumferentially located inclined slides which each engage a pair of rollers which are fixed to the shell. The rollers in each pair are offset to define an angle of inclination which corresponds to the inclination of the slides. Thus, as the counter-hoop is rotated in one sense, the slides and rollers engage, drawing the counter hoop down against the head rim and so tensioning the head. Rotation in the other sense has the opposite effect. The counter-hoop is rotated by means of a rack which is fixed to the counter-hoop, and a pinion fixed to the shell; as the pinion is rotated, the rack is driven circumferentially. The arrangement shown in the second reference is very similar except that the rollers are replaced by inclined nylon blocks.

A disadvantage of these arrangements is that even tensioning is still difficult to achieve in practice, partly due to unevenness and imperfections in the heads and partly due to the difficulties in attaching the rollers or blocks accurately to the shell.

This problem is addressed in the present Applicant's co-pending application No. 9511862.6 which provides a drum comprising: a drum shell; a drum head having a skin extending over an open end of the shell and a circumferential hoop lying outside the open end of the shell; a counter-hoop lying over the head hoop, the counter-hoop having a plurality of circumferentially-spaced inwardly-facing cam followers; and means for rotating the counter-hoop about the drum axis with respect to the drum shell; the drum also including a shell ring attached to and surrounding the shell in the vicinity of the open end and a compression ring located between the counter-hoop and the head hoop; the shell ring having a plurality of circumferentially-spaced, outwardly facing cam members which respectively engage the counter-hoop cam followers.

However, a simpler arrangement may be advantageous in certain circumstances. It is therefore an object of the present invention to provide a drum in which the drum skin can be tensioned and tuned in a single operation and which is simpler in construction than existing designs.

SUMMARY OF THE INVENTION

According to the invention, there is provided a drum comprising: a drum shell, a drum head having a skin extending over an open end of the shell and a circumferential hoop lying outside the open end of the shell; a counter-hoop lying over the head hoop; and a shell ring fixed relative to and surrounding the shell in the vicinity of the open end; the counter-hoop and the shell hoop each having a radially outwardly extending portion, the outwardly extending portions being such that the counter-hoop portion is inclined downwards and/or the shell hoop portion is inclined upwards; the drum also including a clamp ring which surrounds the drum shell and engages the two outwardly extending portions, the clamp ring being capable of radial expansion and contraction.

Thus, as the clamp ring contracts, it exerts an inward compression force which tends to draw the counter-hoop towards the shell hoop which tensions the drum skin.

The counter-hoop bears directly on the head hoop. However, optionally, a compression ring may be located between the counter-hoop and the head hoop. The location of the shell ring can be achieved with considerable accuracy, thus minimising the likelihood of uneven forces being applied to the head hoop by the counter-hoop.

The outwardly extending portion of the counter-hoop is preferably a continuous flange. The shell hoop may be discontinuous and may even be constituted by circumferentially spaced blocks or bosses, however, the shell hoop is preferably a continuous ring and the outwardly extending portion is preferably a continuous flange. The shell hoop may be screwed, bolted or glued to the shell and/or is preferably let into a channel formed in the shell. When the shell hoop is let into a channel, it may have a breach so that it may be snapped into place. An outer clamp ring (such as a hose-clip) may be used additionally to hold the shell hoop in place.

Preferably, the counter-hoop is of stainless steel which is preferably polished. The compression ring (if included) may be of any suitable deformable material and is preferably also resilient; a convenient material is NEOPRENE (T.M.).

The clamp ring is preferably made of a strong non-elastic but resilient material such as steel. It preferably includes radially inwardly extending rails which are inclined in a way which corresponds to any inclination of the outwardly extending portions of the counter-hoop and shell hoop. Preferably, the inclinations are symmetrical.

The clamp ring may be radially contractable by reducing its circumferential length. This may be achieved by the clamp ring being in the form of a breached circular band; by moving the ends at the breach relative to each other circumferentially, the effective circumference of the clamp ring can be varied. In order to control this adjustment, the clamp ring may have a screw thread arrangement spanning the breach. Preferably a first end of the clamp ring on one side of the breach has an internally threaded member, while the second end of the clamp ring on the other side of the breach has a bush. A bolt may then pass through the bush and into the threaded member, so that as the bolt is rotated, it is drawn through the threaded member and the bolt head will S bear against the bush. Continued rotation will move the bush towards the threaded member and so tighten the clamp ring.

Alternatively, the clamp ring may be in the form of a circular band with overlapping ends; by moving the end circumferentially the effective circumference of the clamp ring can be varied. The clamp ring may be provided with a rack and pinion, or a worm gear in order to achieve the desired adjustability.

In a further alternative, the clamp ring may comprise a series of segments with a cross-section as described above. The segments are attached to an outer ring or band. The attachment may be by means of welding, rivets, bolts etc. There may be four or more segments; six or eight might be typical though a greater number may be appropriate in the case of larger drums. This arrangement may be particularly applicable for drums such as tympanis when precise tuning is of great importance.

Preferably, the clamp ring is hinged in a position remote from the breach, conveniently at a position opposite the breach. This arrangement will allow the clamp ring to be fitted in position more readily. Preferably, the hinge connection is an adjustable, quick-release mechanism. In this way, the clamp ring can not only be opened but can also be released and removed very rapidly. If necessary, coarse adjustment of the clamp ring can be effected before the clamp ring is re-fitted.

The invention may be particularly applicable to tympanis. The counter-hoop could be reduced in height in order that it should not protrude above the level of the drum skin. In order to tune the instrument, a flexible drive may be provided, connected to a foot pedal. The drive would then also engage the bolt. As the foot pedal is operated, the bolt is tightened or loosened and the pitch of the skin is adjusted. Alternatively, an electrical drive operated by the foot pedal could be employed to rotate the bolt.

The invention can also be applied to toy drums, tambourines, bongo drums and other drums played by the hands. Again, the counter-hoop would be reduced in height to avoid a rim protruding above the level of the skin.

Possibly, a series of buffers may be provided on the drum shell, in order to protect the surface of the shell. The buffers are preferably arranged circumferentially about the shell near the top and bottom. They may each comprise a resilient insert in a metal housing. The insert is preferably of SANTOPRENE (T.M.) and the housing of polished stainless steel. The buffers are of particular benefit when different sized drums are stored one inside the other, a realistic possibility in accordance with the invention in view of the fact that the heads can be removed very simply.

BRIEF DESCRIPTION OF THE DRAWINGS

The invention may be carried into practice in various ways and one embodiment will now be described by way of example with reference to the accompanying drawings, in which:

FIG. 3 is a plan view of the clamp ring tensioning mechanism;

FIG. 4 is a side view of the clamp ring tensioning mechanism;

DETAILED DESCRIPTION OF PREFERRED EMBODIMENTS

Figure 1:
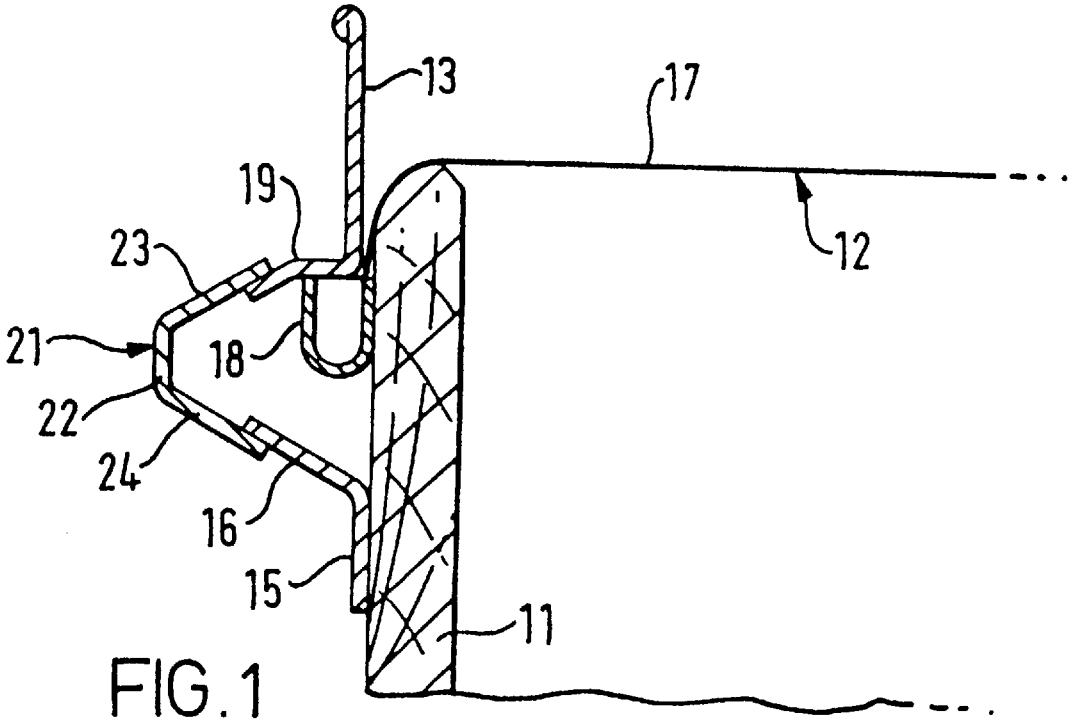
FIG. 1 is a partial vertical section through one wall of a drum in accordance with the present invention.
Figure 2:
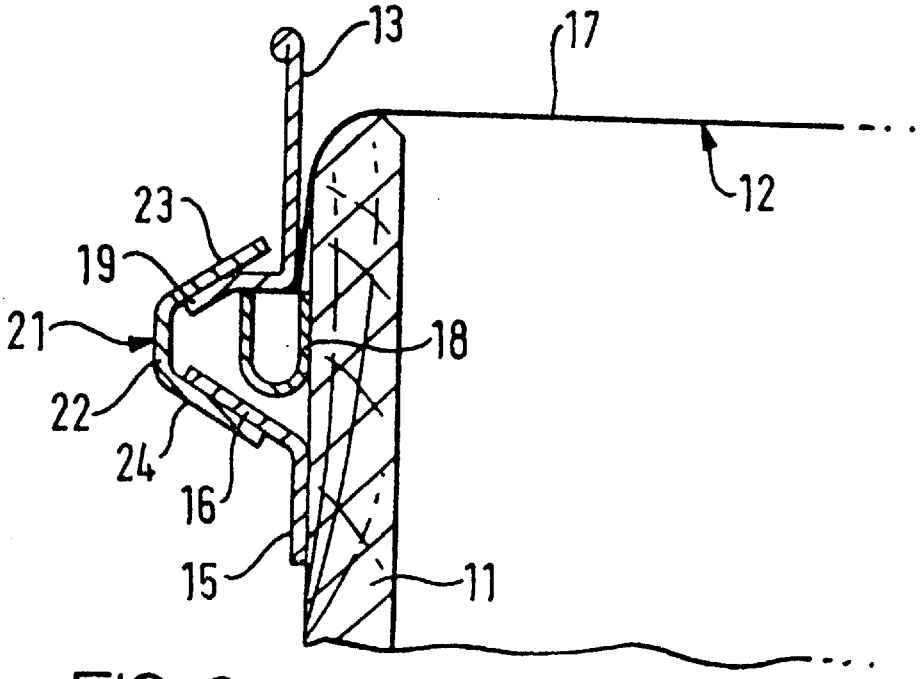
FIG. 2 is a view similar to FIG. 1 showing the drum head tensioned.

As shown in FIGS. 1 and 2, the drum comprises a drum shell 11, a drum head 12, a counter-hoop 13, and a shell hoop 15. The drum shell 11 is of standard laminated resin bonded hardwood construction. It is cylindrical and open ended. The shell hoop 15 is of polished stainless steel and is rigidly attached around the top of the shell 11. The shell hoop has a rim 16 which extends upwardly and outwardly.

The head 12 comprises a skin 17 and a flesh hoop or bead 18 at its periphery. The bead 18 is located outside the drum shell 11 so that the skin 17 stretches over the open end. The counter-hoop 13 is of polished stainless steel and has a downwardly and outwardly extending flange 19. The flange 19 of the counter-hoop 13 bears on the bead 18.

The counter-hoop 13 is held in position by a clamp ring 21. The clamp ring 21 is a steel band with a C-shaped cross-section comprising a generally flat spine 22 with upper and lower skirts 23,24. The skirts 23,24 extend inwardly and diverge with inclinations corresponding to those of the rim 16 and flange 19. Thus, when in position, the upper skirt 23 fits over the flange 19 on the counter-hoop 13 and the lower skirt 24 fits beneath the shell hoop rim 16.

Figure 5:
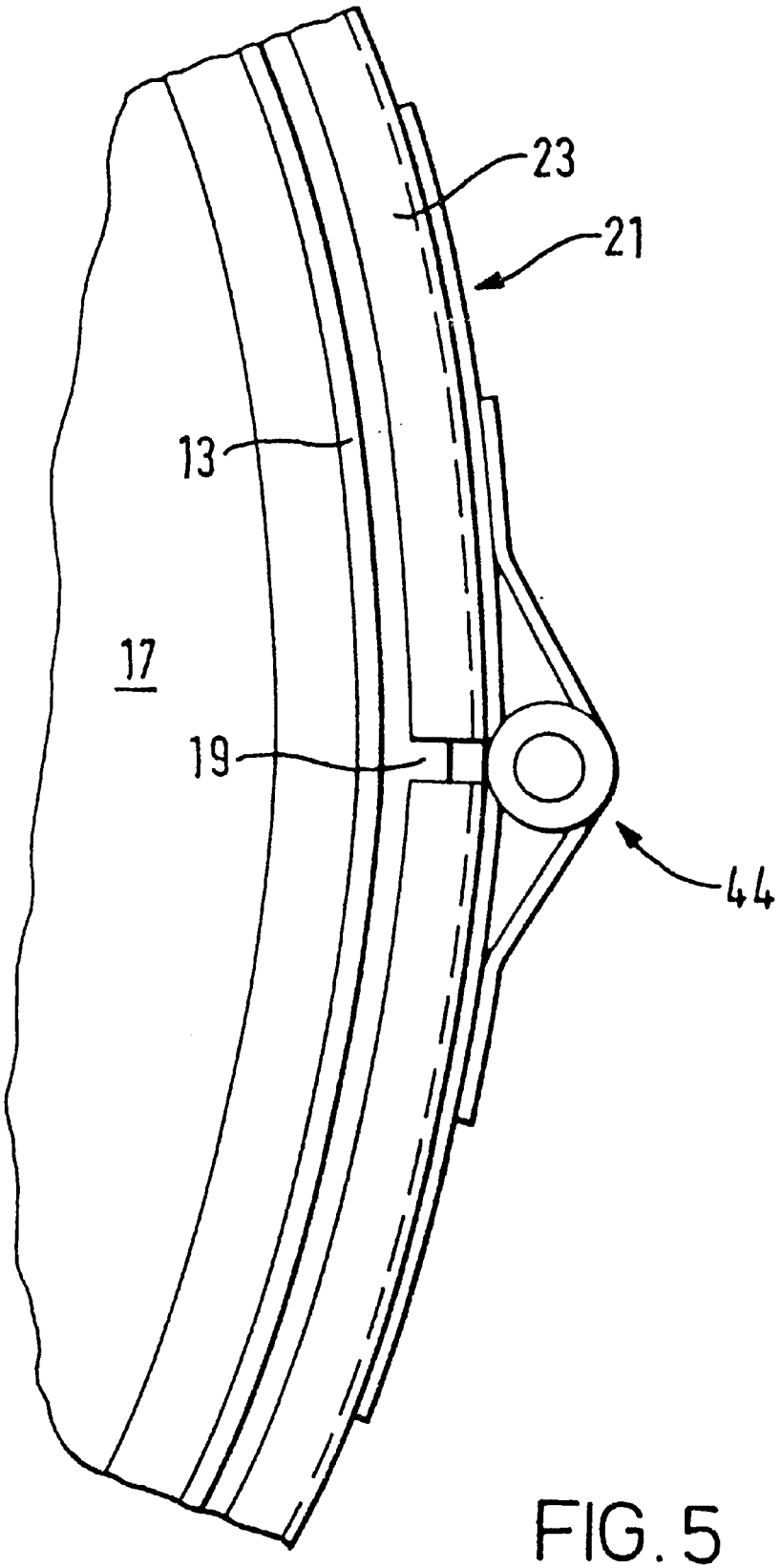
FIG. 5 is a plan view of the clamp ring hinge.

As shown in FIGS. 3, 4 and 5, the clamp ring 21 has a breach 41 defining two ends 42,43 and, diametrically opposite, a hinge 44. A threaded nut 45 is attached to one end 42 of the clamp ring 21 and a bush 46 is attached to the other end 43. A threaded bolt 47 with a head 48 passes through the bush 46 and engages the nut 45. The bolt head 48 has a hexagonal portion 49 and a through-hole 51 passing through the head at right angles to the bolt axis.

In use, when the components are assembled, the head 12 is placed over the open end of the shell 11 and the counter-hoop 13 is located on the bead 18. The clamp ring 21 is then located outside the counter-hoop 13 and shell ring 15. This is facilitated by the hinge 44, which allows the clamp ring 21 to open. The bolt 47 is then tightened (either by the hexagonal head 49 or by a metal rod or the like passing through the through-hole 51) and the clamp ring 21 is constricted. As the clamp ring 21 constricts, the skirts 23,24 engage the flange 19 and rim 16, so locating the counter-hoop 13. As the clamp ring 21 is tightened further, the counter-hoop 13 is drawn down by the dual camming action of the two skirts 23,24.

This in turn exerts a downward pressure on the bead 18 which stretches the skin 17 evenly over the rim of the shell 11. To remove the skin 12, it is simply necessary to reverse the operation, or to open the quick release mechanism.

It has been found in practice that with this arrangement it is possible to achieve a downward movement of the counter-hoop 13 of up to 6 mm, from the point at which the counter-hoop 13 engages the bead 18. This is more than sufficient to enable the drum skin 17 to be tuned.

Figure 6:
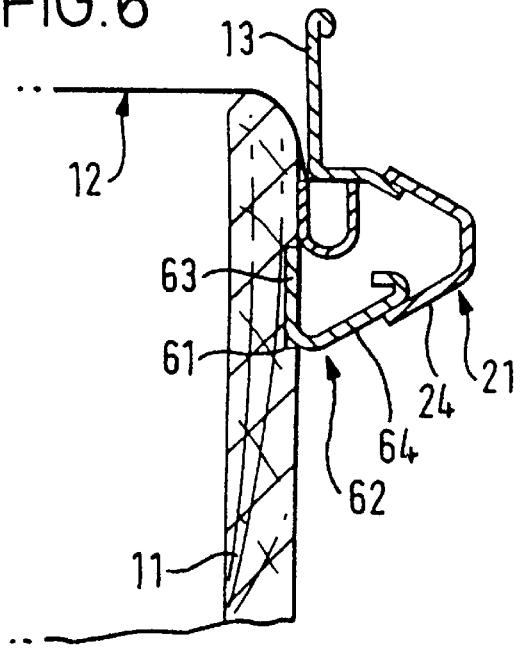
FIGS. 6 and 7 are views similar to FIGS. 1 and 2 showing a second, and preferred, embodiment.
Figure 7:
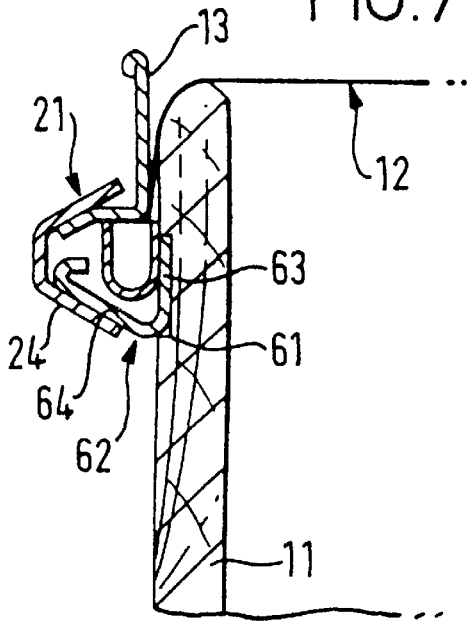

The embodiment shown in FIGS. 6 and 7 is similar to the previous embodiment other than in the form and disposition of the shell hoop. In this embodiment, a channel 61 is formed around the periphery of the drum shell 11, near the top. A shell hoop 62 is located in this channel and may be fixed in position by means of a suitable adhesive and/or bolts or the like though this may not be necessary.

The shell hoop 62 comprises a vertical upwardly extending skirt 63 and an upwardly and outwardly inclined rim 64. The skirt 63 sits in the channel 61. The inclined rim 64 is turned inwards at its outer periphery and cooperates with the lower skirt 24 of the clamp ring 21.

The arrangement has the advantage that as the clamp ring 21 is tightened, there is no tendency to pull the shell hoop 62 away from the drum shell 11. On the contrary, the shell hoop 62 is forced into closer contact with the drum shell 11 as the clamp ring 21 is tightened.

A further advantage is that there is probably no real need for the shell hoop 62 to be positively attached to the drum shell 11. This in turn means that the drum shell does not need to be drilled to accept bolts and so the integrity of the drum shell 11 is maintained.

Figure 8:
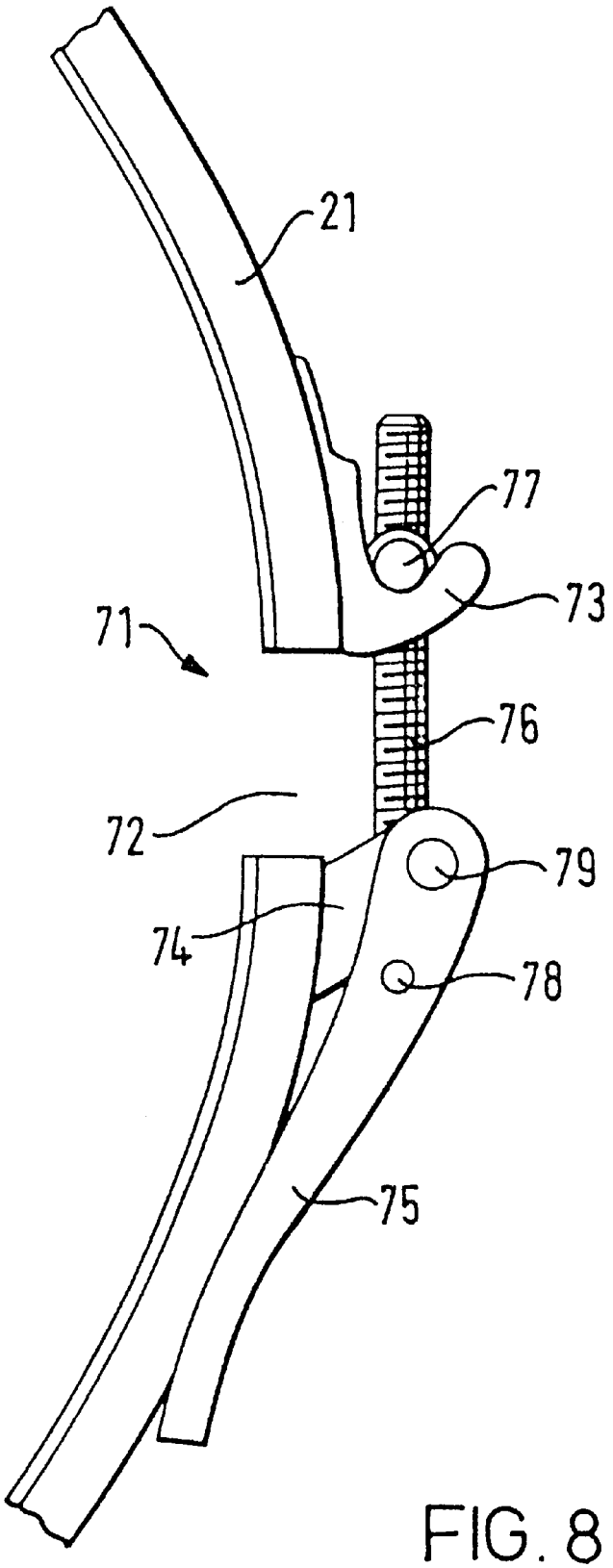
FIG. 8 is a plan view of a preferred quick-release mechanism.

In a preferred embodiment as shown in FIG. 8 the hinge takes the form of an adjustable, quick release mechanism 71. Effectively, therefore, the clamp ring 21 comprises two half-circles, joined at one breach 41 by means of the nut 45, the bush 46 and the bolt 47, and joined at the other breach 72 by means of the adjustable quick-release mechanism 71.

The quick release mechanism 71 comprises a pair of hook members 73 (one of which is shown), a yoke 74, a lever 75 and a bolt 76 which carries a threaded, two-headed nut 77. The hook members 73 are fixed to the clamp ring 21 on one side of the breach 72 while the yoke 74 is fixed to the clamp ring 21 on the other side of the breach 72.

The bolt 76 is pivot ally attached to the lever 75 at a rear pivot point 78 while the lever 75 is pivotally mounted on the yoke 74 at forward pivot point 79. In the closed position, the two heads of the nut 77 are located behind the hook members 73.

Due to the relative locations of the pivot points 78,79, forward movement of the lever 75 moves the heads of the nut 77 out of engagement with the hook members 73, thus releasing the mechanism. To re-lock the mechanism, the heads of the nut 77 are located behind the hook members with the lever 75 in the forward position, and the lever 75 is then moved back to the position shown in FIG. 8. This draws back the bolt 76 and locates the heads of the nut 77 behind the hook members 73.

It will be appreciated that by moving the nut 77 along the bolt 76, the effective circumference of the clamp ring 21 can be adjusted, thus varying the tension in the clamp ring 21.

Figure 9:
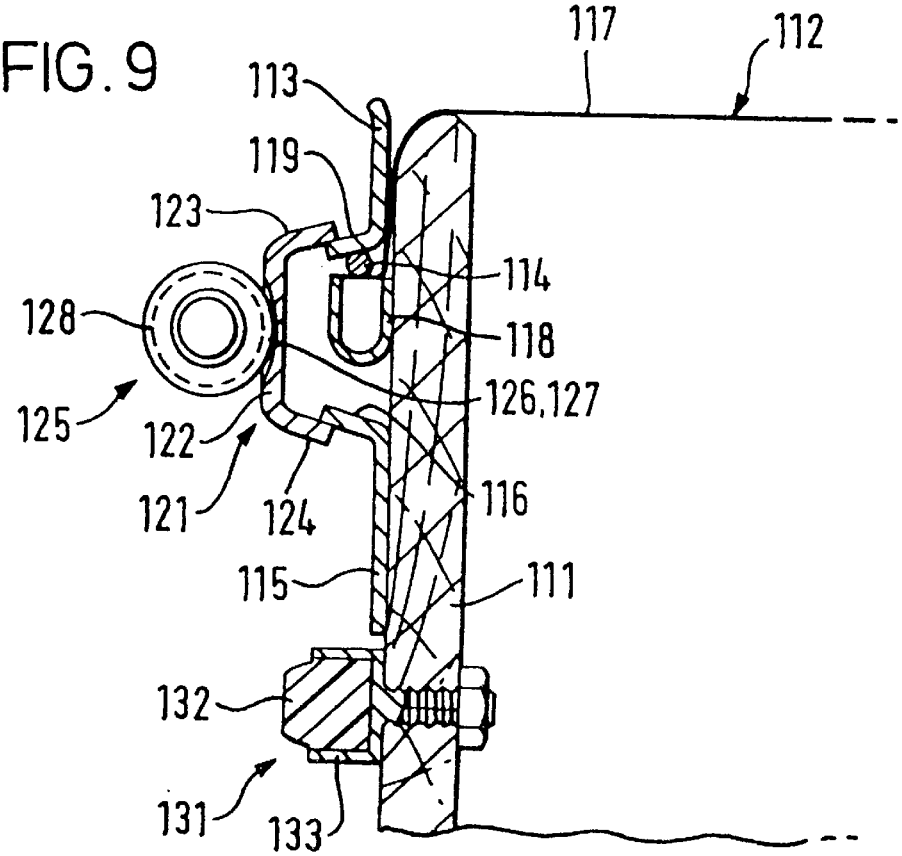
FIG. 9 is a partial vertical section through one wall of a drum in accordance with another embodiment of the present invention.

In the embodiment shown in FIG. 9, the drum comprises a drum shell 111, a drum head 112, a counter-hoop 113, a compression ring 114 and a shell hoop 115. The compression ring 114 is located between the flange 119 of the counter-hoop 113 and the bead 118.

The counter-hoop 113 is held in position by a clamp ring 121. The clamp ring 121 is a steel band with overlapping ends, and a C-shaped cross-section comprising a generally flat spine 122 with upper and lower skirts 123,124. The skirts 123,124 extend inwardly and diverge with inclinations corresponding to those of the rim 116 and flange 119. Thus, when in position, the upper skirt 123 fits over the flange 119 on the counter-hoop 113 and the lower skirt 124 fits beneath the shell hoop rim 116.

The clamp ring 121 also has a worm gear mechanism 125. The spine 122, in the region of the overlapping ends of the band, is formed with teeth 126 which mesh with corresponding teeth 127 on a worm drive 128. The worm drive 128 is attached to the underlying section of the band (not shown).

Optionally, the drum may be provided with a series of buffers 131 which are bolted to the shell 111. The buffers 131 each comprise a resilient insert 132 located within a polished stainless steel cup 133 which is bolted through the shell 111.

In use, when the components are assembled, the head 112 is placed over the open end of the shell 111, the compression ring 114 is located on the bead 118 and the counter-hoop 113 is rested on the compression ring 114. The clamp ring 121 is then located outside the counter-hoop 113 and shell ring 115 and is tightened using the worm gear 125. Any slight unevenness in the skin 117 is compensated for by the compression ring 114.

What is claimed is:

1. A drum comprising:

a drum shell having an open end;

a drum head having a skin extending over the open end of the shell and a circumferential head hoop lying outside the open end of the shell;

a counter-hoop lying over the circumferential head hoop;

a shell hoop fixed relative to and surrounding the shell in the vicinity of the open end; and a clamp ring surrounding the drum shell;

and wherein the counter-hoop and the shell hoop each have a radially outwardly extending portion the respective outwardly extending portions being such that the counter-hoop portion is inclined away from the open end of the shell and the shell hoop portion is inclined towards the open end of the shell;

the clamp ring being arranged to engage the two outwardly extending portions and being capable of radial expansion and contraction;

the clamp ring including radially inwardly extending rails which are inclined in a way which corresponds to any inclination of the respective outwardly extending portion of the counter-hoop and shell hoop.

2. A drum as claimed in claim 1, wherein the outwardly extending portion of the counter-hoop is inclined downwards while the outwardly extending portion of the shell hoop is conversely inclined upwards.

3. A drum as claimed in claim 1, wherein the outwardly extending portion of the counter-hoop is a continuous flange.

4. A drum as claimed in claim 1, wherein the shell hoop is a continuous ring including a breach, and the outwardly extending portion is a flange which is continuous other than in the position of the breach.

5. A drum as claimed in claim 1, wherein that the shell hoop is let into a channel formed in the shell.

6. A drum as claimed in claim 1, wherein the counter-hoop is of stainless steel.

7. A drum as claimed in claim 1, wherein the clamp ring is in the form of a circular band with a breach and two ends at the breach, the two ends being movable relative to each other in a circumferential sense whereby the circumference of the clamp ring can be varied.

8. A drum as claimed in claim 7, wherein the clamp ring includes a screw thread arrangement spanning the breach.

9. A drum as claimed in claim 8, wherein a first end of the clamp ring on one side of the breach has an internally threaded member while the second end of the clamp ring on the other side of the breach has a bush, and a bolt passes through the bush and into the threaded member.

10. A drum as claimed in claim 7, wherein the clamp ring includes a hinge in a position remote from the breach.

11. A drum as claimed in claim 10, wherein the hinge is an adjustable quick release mechanism.

12. A drum as claimed in claim 2, wherein the outwardly extending portion of the counter-hoop is a continuous flange.

13. A drum as claimed in claim 2, wherein the shell hoop is a continuous ring including a breach, and the outwardly extending portion is a flange which is continuous other than in the position of the breach.

14. A drum as claimed in claim 13, wherein the shell hoop is let into a channel formed in the shell.

15. A drum as claimed in claim 14, wherein the clamp ring is in the form of a circular band with a breach and two ends at the breach, the two ends being movable relative to each other in a circumferential sense whereby the circumference of the clamp ring can be varied.

16. A drum as claimed in claim 15, wherein the clamp ring is hinged in a position remote from the breach.

17. A drum comprising:

a drum shell having an open end;

a drum head having a skin extending over the open end of the shell and a circumferential head hoop lying outside the open end of the shell;

a counter-hoop lying over the circumferential head hoop;

a shell hoop fixed relative to and surrounding the shell in the vicinity of the open end; and a clamp ring surrounding the drum shell;

and wherein the counter-hoop and the shell hoop each have a radially outwardly extending portion the respective outwardly extending portions being such that the counter-hoop portion is inclined away from the open end of the shell and the shell hoop portion is inclined towards the open end of the shell;

the clamp ring being arranged to engage the two outwardly extending portions and being capable of radial expansion and contraction;

the clamp ring being in the form of a circular band with a breach and two ends at the breach, the two ends being movable relative to each other in a circumferential sense whereby the circumference of the clamp ring can be varied.

18. A drum as claimed in claim 17, wherein the outwardly extending portion of the counter-hoop is inclined downwards while the outwardly extending portion of the shell hoop is conversely inclined upwards.

19. A drum as claimed in claim 17, wherein the shell hoop is a continuous ring including a breach, and the outwardly extending portion is a flange which is continuous other than in the position of the breach.

20. A drum as claimed in claim 19, wherein the clamp ring includes radially inwardly extending rails which are inclined in a way which corresponds to any inclination of the respective outwardly extending portion of the counter-hoop and shell hoop.

21. A drum comprising:

a support having an end;

a drum head having a skin extending over the end of the support and a circumferential head hoop lying outside the end of the support;

a counter-hoop lying over the circumferential head hoop;

a support hoop fixed relative to and surrounding the support in the vicinity of the end; and a clamp ring surrounding the support;

and wherein the counter-hoop and the support hoop each have a radially outwardly extending portion, the respective outwardly extending portions being such that the counter-hoop portion is inclined away from the end of the support and the support hoop portion is inclined towards the end of the support;

the clamp ring being arranged to engage the two outwardly extending portions and being capable of radial expansion and contraction;

the clamp ring including radially inwardly extending rails which are inclined in a way which corresponds to any inclination of the respective outwardly extending portion of the counter-hoop and support hoop.

22. A drum as claimed in claim 21, wherein the support comprises a drum shell.

23. A drum as claimed in claim 21, wherein the support has a cylindrical shape.

24. A drum as claimed in claim 21, wherein the support is of laminated resin bonded hardwood construction.

25. A drum as claimed in claim 21, wherein the support is in supporting contact with the skin.

26. A drum as claimed in claim 21, wherein the end is an open end of the support.

27. A drum as claimed in claim 21, wherein the clamp ring is in the form of a circular band with a breach and two ends at the breach, the two ends being movable relative to each other in a circumferential sense whereby the circumference of the clamp ring can be varied.

* * * * *